US008439654B2

(12) United States Patent
Cho

(10) Patent No.: US 8,439,654 B2
(45) Date of Patent: May 14, 2013

(54) METHODS AND APPARATUS FOR PUMPING LIQUEFIED GASES

(75) Inventor: Hyun Cho, Katy, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1102 days.

(21) Appl. No.: 11/646,680

(22) Filed: Dec. 28, 2006

(65) Prior Publication Data

US 2008/0156382 A1 Jul. 3, 2008

(51) Int. Cl.
*F04B 17/00* (2006.01)
*F04B 35/00* (2006.01)

(52) U.S. Cl.
USPC ..... 417/360; 417/423.3; 62/50.6

(58) Field of Classification Search ..... 417/423.3, 417/423.14, 360; 62/50.6
See application file for complete search history.

(56) References Cited

U.S. PATENT DOCUMENTS

| | | | | | |
|---|---|---|---|---|---|
| 3,112,049 | A | * | 11/1963 | Messer | 417/423.15 |
| 3,963,381 | A | * | 6/1976 | Kohnen | 417/360 |
| 4,080,106 | A | * | 3/1978 | Haesloop | 417/53 |
| 4,174,791 | A | * | 11/1979 | Auchter et al. | 222/333 |
| RE31,445 | E | | 11/1983 | Carter | |
| 4,435,132 | A | * | 3/1984 | Haesloop et al. | 417/360 |
| 4,472,946 | A | * | 9/1984 | Zwick | 62/50.6 |
| 5,659,214 | A | * | 8/1997 | Guardiani et al. | 417/423.12 |
| 5,865,605 | A | * | 2/1999 | Weidlein | 417/360 |
| 7,356,996 | B2 | * | 4/2008 | Brook et al. | 417/901 |

* cited by examiner

*Primary Examiner* — Peter J Bertheaud
(74) *Attorney, Agent, or Firm* — KBR IP Legal Dept.

(57) ABSTRACT

A method and system for pumping liquefied gas are provided. The system for pumping liquefied gas can includes a container having an access port with a central axis disposed at an upper end thereof, a pump disposed within the container, and at least one pipe segment having a first end and a second end. The pump can include a fluid inlet in fluid communication with a liquefied gas stored in the container and a fluid outlet. The first end of the pipe segment can be in fluid communication with the fluid outlet of the pump. The second end of the pipe segment can be in fluid communication with an exterior of the container. The pump can be capable of lifting the liquefied gas through the at least one pipe segment and discharging the liquefied gas from the container at a pressure sufficient for distribution or further processing.

8 Claims, 5 Drawing Sheets

METHODS AND APPARATUS FOR PUMPING LIQUEFIED GASES

BACKGROUND

1. Field

Embodiments herein generally relate to liquefied gases. More particularly, the embodiments relate to methods and apparatus for pumping liquefied gases from storage containers.

2. Description of the Related Art

Liquefied gas is stored in cryogenic storage containers prior to use or during transportation. The more common liquefied gases, include liquefied natural gas (LNG), liquefied petroleum gas (LPG), liquefied energy gas (LEG), liquefied ethylene, natural gas liquid, liquefied methane, liquefied propane, liquefied butane, and liquefied ammonia. Such liquefied gases are extremely volatile and flammable and therefore require special care. Systems for pumping liquefied gases from the storage container have utilized a two pump system, a smaller pump submerged in the liquid within the container and a larger, high head pump located outside the container.

FIG. 1 depicts an illustrative prior art liquefied gas container system. An in-tank pump 30 is enclosed within a column or casing 20 located within the tank or container 10. A booster pump or second pump 80 is located outside the container 10 and is used to boost the fluid pressure to end-use requirements. A sealing gland 150 is placed on top of the container 10 to prevent gas and fluid leakage during pumping.

A foot valve 40 is typically located at the bottom of the column 20 beneath the in-tank pump 30 to regulate suction flow to the in-tank pump 30. The foot valve 40 is normally closed and is actuated to an open position when the in-tank pump 30 rests thereon. Routine maintenance and service of the foot valve 40 is an inherent problem and challenge, especially if the foot valve 40 were to fail. Most foot valves fail open and the fluid is allowed to flow into the casing 20. If a foot valve were to fail closed, which is very rare, large volumes of product might be sealed into the container 10, making recovery difficult. In the field, when foot valves like valve 40 fail to open, typically no attempt is made to repair the valve since the fluid can still enter the pump and removal operations can continue.

The in-tank pump 30 is typically a one or two stage impeller pump that produces relatively low discharge pressures such as below about 15 bar. The first pump 30 transfers the liquid from the inside of the container 10 through the column 20 to a send out pipe 70 in fluid communication with the second pump 80.

The second pump 80 is known as a booster pump. The second pump 80 is located outside the container 10, as shown in FIG. 1. The second pump 80 is typically a multi-stage, high pressure pump. The second pump 80 may have discharge pressures of about 85 bar or more. From the second pump 80, the liquefied gas enters a distribution system (not shown) for further processing, vaporization, and/or use.

BRIEF DESCRIPTION OF THE DRAWINGS

So that the manner in which the above recited features of the present embodiments can be understood in detail, a more particular description of the embodiments, briefly summarized above, may be had by reference to embodiments, some of which are illustrated in the appended drawings. It is to be noted, however, that the appended drawings illustrate only typical embodiments and are therefore not to be considered limiting of its scope, for the embodiments may admit to other equally effective embodiments.

DETAILED DESCRIPTION

A detailed description will now be provided. Each of the appended claims defines a separate embodiment, which for infringement purposes is recognized as including equivalents to the various elements or limitations specified in the claims. Depending on the context, all references below to the "embodiment" may in some cases refer to certain specific embodiments only. In other cases it will be recognized that references to the "embodiment" will refer to subject matter recited in one or more, but not necessarily all, of the claims. Each of the embodiments will now be described in greater detail below, including specific embodiments, versions and examples, but the embodiments are not limited to these embodiments, versions or examples, which are included to enable a person having ordinary skill in the art to make and use the embodiments, when the information in this patent is combined with available information and technology.

Systems for pumping liquefied gas and a liquefied gas storage system are provided. In at least one embodiment, the system for pumping liquefied gas includes a container having an access port with a central axis disposed at an upper end thereof, a pump disposed within the container, and at least one pipe segment having a first end and a second end. The pump includes a fluid inlet in fluid communication with the liquefied gas stored in the container and a fluid outlet. The first end of the pipe segment is in fluid communication with the fluid outlet of the pump. The second end of the pipe segment is in fluid communication with an exterior of the container. The pump is capable of lifting the liquefied gas through the at least one pipe segment and discharging the liquefied gas from the container at a pressure sufficient for distribution or further processing.

Figure 1:
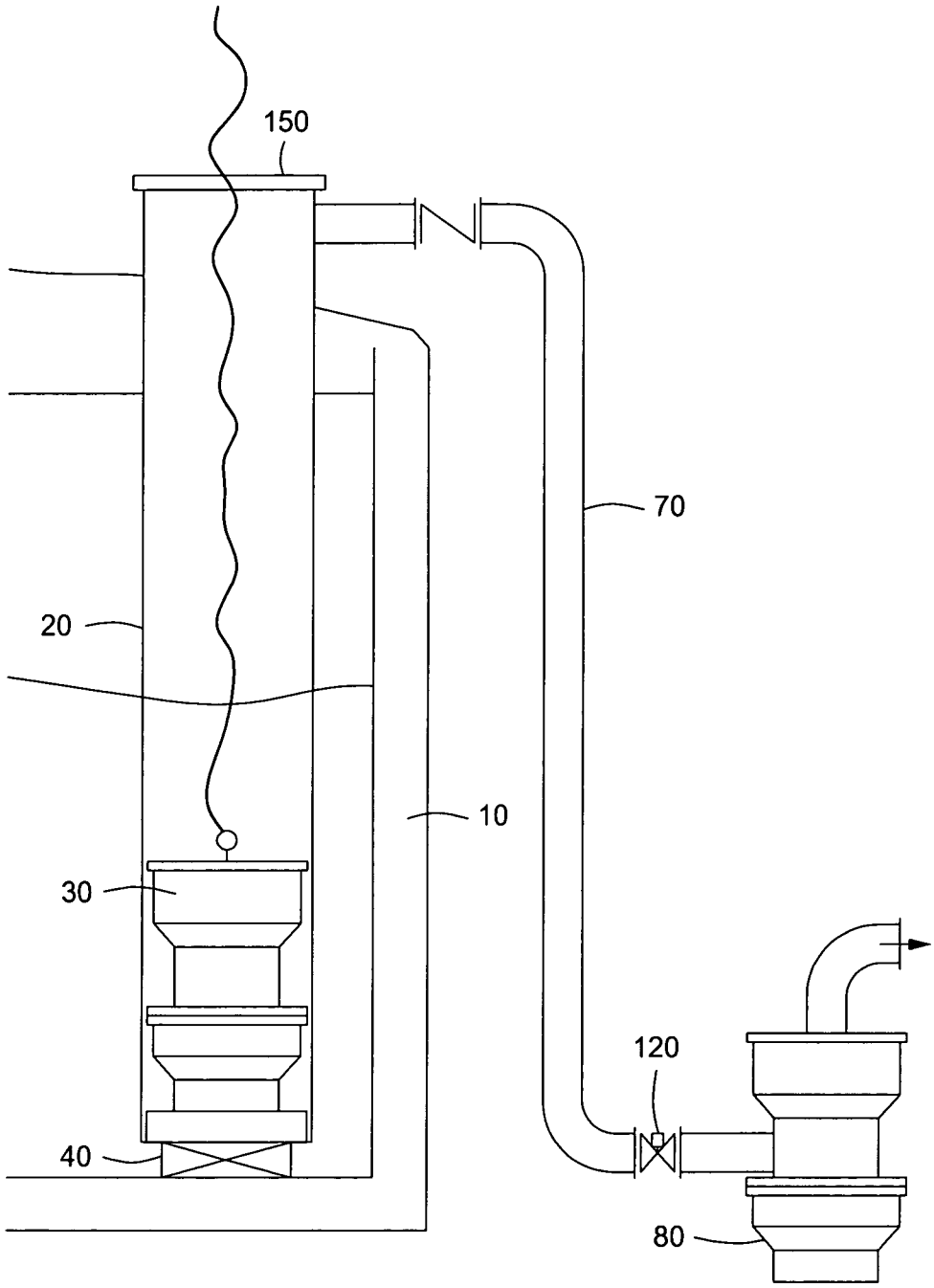
FIG. 1 (PRIOR ART)
FIG. 1 depicts an illustrative prior art liquefied gas container system.
Figure 2:
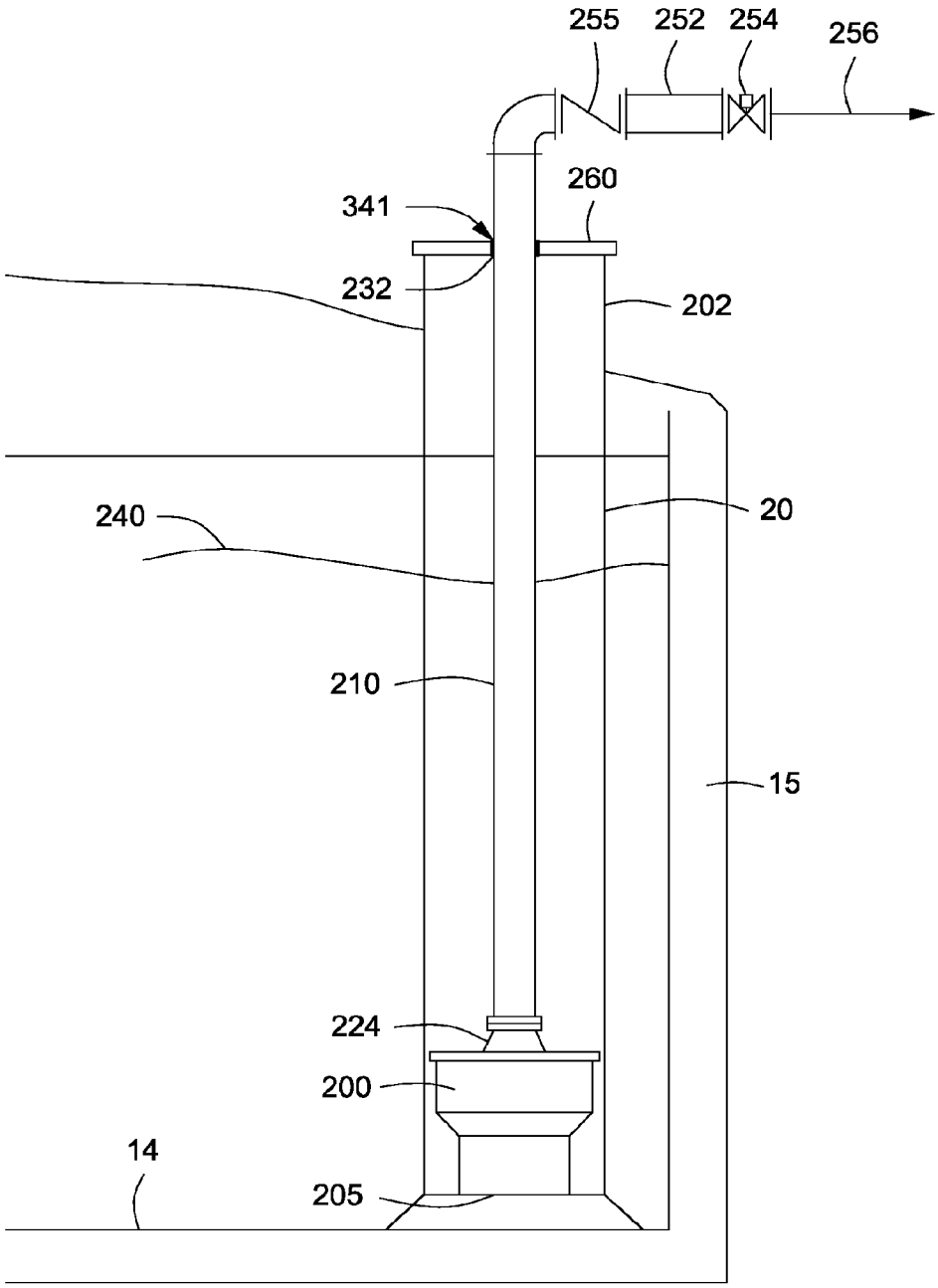
FIG. 2 depicts a partial schematic of an illustrative liquefied gas storage system according to one or more embodiments described.

With reference to the figures, FIG. 2 depicts a partial schematic of an illustrative liquefied gas storage system according to one or more embodiments described. The storage system can include a tank or container 15, pump 200, fluid discharge pipe 210, access port 202, and sealing gland 260. The sealing gland 260 is disposed on an upper end of the access port 202 to seal off the container 15. Although not shown, the pump 200 can sit directly or otherwise rest on the floor 14 of the container 15. Even though the floor 14 of the container 15 is depicted as being flat, in one or more embodiments, the floor 14 is not flat. For example, the floor 14 can be designed to slope such that when the container 15 is near empty, the fluid can puddle below the pump 200 allowing the container 15 to be drained as completely as possible.

In one or more embodiments, the pump 200 can be suspended within the container 15 so that fluid can enter the pump inlet 205. For example, the pump 200 can be suspended within the container 15 from the fluid discharge pipe 210 or other conduit. In one or more embodiments, the pump 200 can be mounted on a pedestal (not shown) disposed on the floor 14 of the container 15.

The pipe 210 can be one or more sections of pipe, depending on the height of the container 15. For example, two or more pipes 210 can be welded, threaded, or otherwise adjoined together to provide a continuous conduit or flow path. The pipe 210 can be in fluid communication with the pump 200 at a first end thereof and a send-out pipe or manifold 252 at a second end thereof. The pipe 210 can extend from the pump 200 through the access port 202 and the sealing gland 260 to the exterior of the container 15.

One or more control valves 254 can be located on the flow path along the send out pipe 252. The one or more control valves 254 can be used to regulate or throttle fluid flow therethrough. In one or more embodiments, the send out pipe 252 interfaces with one or more additional pipes or piping segments (not shown) making a fluid path 256 for transferring the fluid for further processing and vaporization without the need for a booster pump.

In one or more embodiments, the pipe 210 can expand or contract depending on operating conditions. For example, as the temperature of the pipe 210 changes from thermal interaction with the liquefied gas 240, the overall length of the pipe 210 becomes shorter when the pipe 210 is made colder and longer when the pipe 210 becomes hotter. In one or more embodiments, the length of pipe 210 can vary as much as ½ inch or more due to temperature changes.

To compensate for changes in operating conditions affecting the length of the pipe 210, one or more misalignment couplers 255 can be used. For example, one or more misalignment couplers 255 can be disposed between the discharge pipe 210 and the send out pipe 252. The misalignment coupler 255 can be adapted to compensate for variations in the length of the pipe 210 due to temperature variations before, during and after normal operations. In one or more embodiments, the misalignment coupler 255 can compensate for tolerance error build up between the height of the pump 200 and the length of the pipe 210. The misalignment coupler 255 can be made from any flexible material, such as a bellows or similar component.

Materials of construction can also affect changes in length to the pipe 210 and the magnitude of those changes due to temperature variations. In one or more embodiments, the pipe 210 can be made from stainless steel to limit the length changes. In one or more embodiments, the pipe 210 can be made from a stainless steel containing about 35% nickel. Stainless steel pipe containing about 35% nickel exhibits less shrinkage due to temperature variations than many other metallic pipes. In one or more embodiments, the pipe can be stainless steel pipe sold under the Trademark name Invar, a pipe containing about 35% nickel. Conventional stainless steel pipe contains about 9% nickel.

Still referring to FIG. 2, the access port 202 can have a central, substantially vertical axis. In one or more embodiments, the access port 202 can be off angle to the vertical. In one or more embodiments, the access port 202 can be located in a top portion of the storage container 15, allowing access to the interior of the container 15, and can be sized to support insertion and removal of the pump 200 and pipe 210 into and out of the container 15.

Considering the pump 200 in more detail, the pump 200 is at least partially disposed within the liquefied gas 240 stored in the container 15. In one or more embodiments, the pump 200 is completely submerged within the liquefied gas 240. The liquefied gas 240 can include, but is not limited to, liquefied natural gas (LNG), liquefied petroleum gas (LPG), liquefied energy gas (LEG), liquefied ethylene, natural gas liquid, liquefied methane, liquefied propane, liquefied butane, other liquefied hydrocarbons, and liquefied ammonia.

In one or more embodiments, the pump 200 is particularly adapted for pumping, lifting or otherwise transferring the liquefied gas 240 out of the container 15. In one or more embodiments, the pump 200 discharges the liquefied gas from an outlet or discharge 224, through the pipe 210, to the send out pipe 252. The discharge pressure of the pump 200 can range from a low of about 0.2 bar to a high of above about 100 bar. In one or more embodiments, the discharge pressure of the pump 200 ranges from a low of about 1 bar to a high of above about 85 bar. In one or more embodiments, the discharge pressure of the pump 200 ranges from a low of about 0.2 bar, 1 bar or 3 bar to a high of above about 50 bar, 75 bar or 90 bar.

Any pump capable of withstanding the cryogenic temperatures within the container 15 and capable of producing the desired discharge pressure can be used. For example, the pump 200 can be a single stage pump or a multi-stage pump. Examples of suitable pumps are commercially available from J. C. Carter, Ebara, and Nikkiso.

In one or more embodiments, the pump 200 is rated for 6,600 volts. Electrical power can be supplied to the pump 200 via one or more power conduits. In one or more embodiments, electrical power can be supplied to the pump 200 by power lines (not shown) not resident within a conduit.

Figure 6:
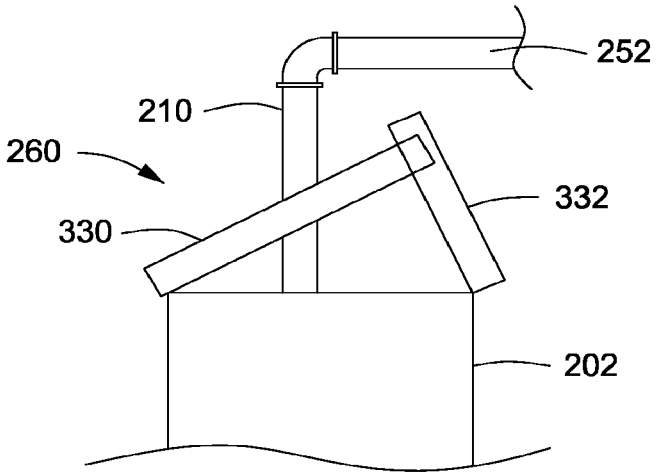
FIG. 6 depicts a schematic side view of another illustrative sealing gland having multiple sections partially surrounding a pipe according to one or more embodiments described.
Figure 7:
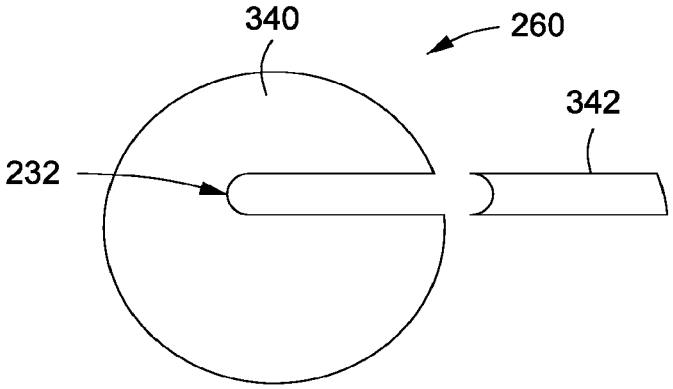
FIG. 7 depicts a schematic top view of another illustrative sealing gland with interlocking segments according to one or more embodiments described.

Considering the sealing gland 260 in more detail, the sealing gland 260 can be disposed on top of the access port 202 to seal off the container 15 as exampled in FIG. 2. In one or more embodiments, the sealing gland 260 can be adapted to cover the top of the access port 202 as shown in FIGS. 6 and 7 which will be discussed in more detail below.

Figure 3:
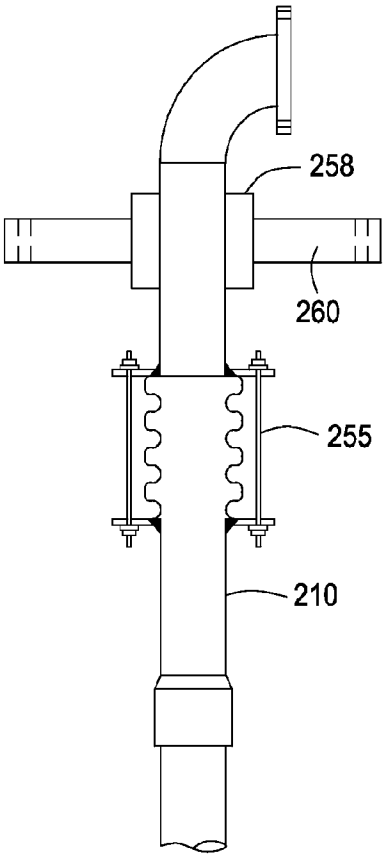
FIG. 3 depicts a partial schematic of an illustrative sealing gland according to one or more embodiments described.

FIG. 3 depicts a partial schematic of an illustrative sealing gland 260 according to one or more embodiments described. In one or more embodiments, an upper portion of the pipe 210 can be disposed through the access port 202 using a stuffing box 258. Stuffing boxes are conventional in the art and any kind suitable for the desired design conditions described can be used. In one or more embodiments, one or more misalignment couplers 255 can be disposed along a length of the pipe 210 below the sealing gland 260 (i.e. within the storage tank) to accommodate movement in both vertical and horizontal directions.

Figure 4:
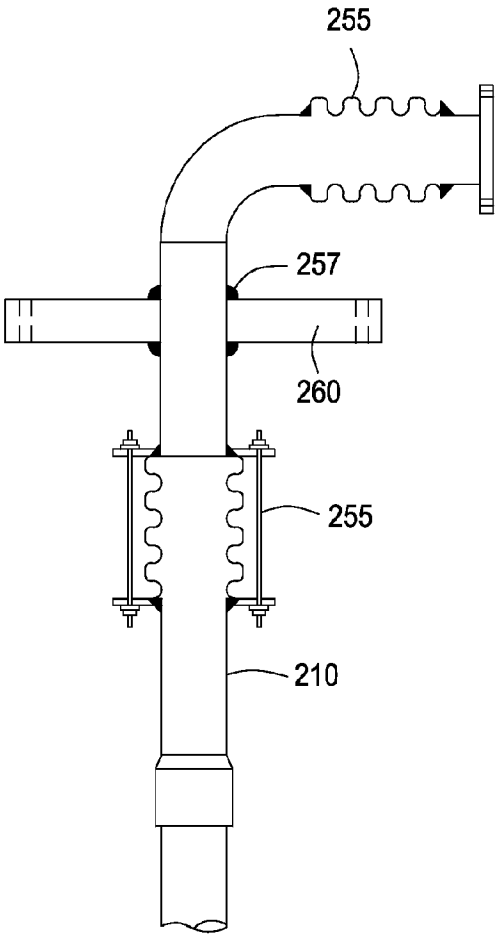
FIG. 4 depicts a partial schematic of another illustrative sealing gland according to one or more embodiments described.

FIG. 4 depicts a partial schematic of another illustrative sealing gland 260 according to one or more embodiments described. An upper portion of the pipe 210 can be disposed through the access port 202 using a stuffing box 258 (shown in FIG. 3) or simply welded in place as depicted in FIG. 4. One or more misalignment couplers 255 can be disposed along a length of the pipe 210 below the sealing gland 260 to accommodate movement in both vertical and horizontal directions. One or more misalignment couplers 255 can also be disposed along a length of the pipe above the sealing gland 260. Also depicted in both FIGS. 3 and 4 are two pipe sections threaded together to form a continuous pipe section 210.

Figure 5:
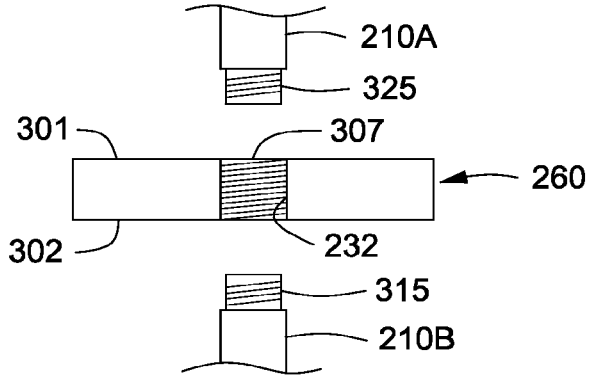
FIG. 5 depicts a partial schematic of yet another illustrative sealing gland according to one or more embodiments described.

FIG. 5 depicts a partial schematic of yet another illustrative sealing gland 260 according to one or more embodiments described. The sealing gland 260 can be a plate or disk like structure having an opposing top surface 301 and bottom surface 302. The sealing gland 260 can include an aperture 232 formed therethrough. The inner surface or inner diameter of the aperture 232 can be threaded with one or more internal threads 307 disposed thereon. The internal threads 307 can be adapted to engage mating threads 315, 325 disposed on one or more pipe sections 210A, 210B. Accordingly, the pipe sections 210A, 210B can be connected to the sealing gland 260 to form a fluid tight seal therebetween.

In one or more embodiments, the aperture 232 has the internal threading 307 in at least a portion of the bottom surface 302 thereof. In one or more embodiments, the threading 307 in the portion of the bottom surface 302 is used for threaded engagement between the gland 260 and the threaded section 315 on the pipe section 210B. In one or more embodiments, the pipe section 210B is part of the pipe or a segment of pipe, such as pipe 210, that is in fluid communication with the discharge of the pump 200 disposed within the container 15, as depicted in FIG. 2.

In one or more embodiments, the aperture 232 has internal threading 307 in at least a portion of the top surface 301. In one or more embodiments, the threading 307 in the top surface 301 is used for threaded engagement between the gland 260 and the threaded section 325 on the pipe section 210A. In one or more embodiments, the pipe section 210A is part of a pipe or a segment of pipe, such as pipe 210 or pipe 252, that is disposed between the pump 200 discharge and the distribution system 256, as depicted in FIG. 2.

In one or more embodiments, if pipe segments 210A, 210B are threadably engaged with the aperture 232, the pipe segments 210A, 210B are placed in fluid communication with the aperture 232. In one or more embodiments, if pipe segments 210A, 210B are threadably engaged with the aperture 232, both pipe ends touch and are placed in direct fluid communication with each other. It should be noted that there is no limitation on how threaded engagement is implemented. All possible alternate threaded engagement combinations between the pipes 210A, 210B, and the aperture 232 can be implemented.

In one or more embodiments, the pipes 210A, 210B can be placed in fluid communication with the aperture 232 by flange mounts, not shown. In one or more embodiments, where flange mounts, understood in the art, are used for engaging the pipes 210A, 210B to the aperture 232, the threading 307 and the threaded sections 315, 325 are not required.

FIG. 6 depicts a schematic side view of another illustrative sealing gland 260 having multiple sections partially surrounding a pipe 210 according to one or more embodiments described. In one or more embodiments, the sealing gland 260 is divided into at least two complementary sections 330, 332 to facilitate entry to the container 15. The sections 330, 332 are shown in a partially open position above the access port 202. In the closed position, the sections 330, 332 surround the pipe 210 creating a seal therearound to prevent gas leakage from the container 15.

In one or more embodiments, the sections 330, 332 can be shifted to an open position by a motor and hinge assembly, not shown. In one or more embodiments, the section 330 and the section 332 can be shifted to an open position by a spring mechanism. In one or more embodiments, the sections 330, 332 can be hinged and manually swung to an open position. In one or more embodiments, the sections 330, 332 can be removed from the access port 202 by manually lifting the sections 330, 332 up and away from the port 202.

FIG. 7 depicts a schematic top view of another illustrative sealing gland 260 with interlocking segments according to one or more embodiments described. The sealing gland 260 can include two or more interlocking segments 340, 342 partially surrounding the pipe 210. In one or more embodiments, the first interlocking segment 340 and the second interlocking segment 342 surround the pipe 210, creating a seal around the pipe 210 sufficient to prevent gas leakage from the container (not shown in this view).

In one or more embodiments, a circumferential seal 341 is disposed in the aperture 232. As depicted in FIG. 2, the circumferential seal 341 can be disposed within the inner diameter of the aperture 232 and adapted to sealing engage the outer diameter of the pipe 210 to create a seal therebetween.

Figure 8:
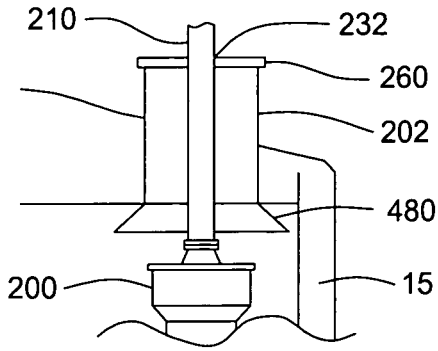
FIG. 8 depicts a partial schematic view of another liquefied gas storage container assembly according to one or more embodiments described.

FIG. 8 depicts a partial schematic view of another liquefied gas storage container assembly according to one or more embodiments described. In at least one specific embodiment, a flanged or flanged member 480 is appended to an interior portion of the container 15, such as the end of the access port 202 as shown. The flange 480 can have a central axis substantially aligned with the central axis of the access port 202. During pump 200 removal, the flange 480 serves as a guide or centering aid to assist removing the pump 200 from the container 15 through the access port 202.

During removal of the pump 200 from the container 15, the pump 200 can be removed by pulling the pipe 210 vertically from the container 15. The pipe 210 can be pulled using techniques similar to those used for removing drilling pipe from a wellbore. In one or more embodiments, the pipe 210 can be inserted and removed from the container 15 using a cable, not shown, attached to the upper most pipe section. In one or more embodiments, the cable is attached to a lifting mechanism resident on a tower tall enough to insert and remove the entire length of the combined pipe sections and the pump into and out of the container 15.

Figure 9:
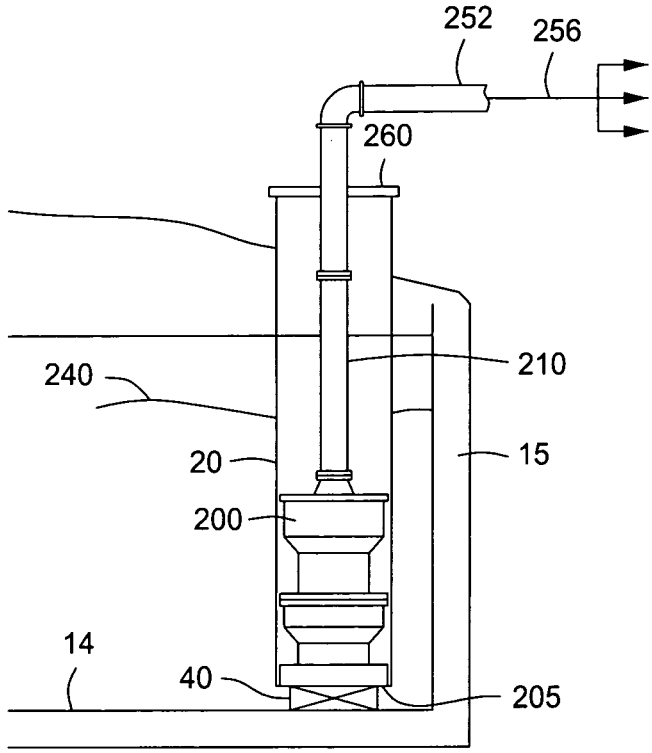
FIG. 9 depicts a partial schematic view of yet another liquefied gas storage container assembly according to one or more embodiments described.

FIG. 9 depicts a partial schematic view of yet another liquefied gas storage container assembly according to one or more embodiments described. In at least one specific embodiment, a column or casing 20 and a foot valve 40 is disposed within the container 15. The pump 200 and pipe 210 are at least partially disposed within the casing 20, and the pump 200 rests on the foot valve 40 located on the bottom surface 14 of the container 15. The pipe 210 extends through the sealing gland 260 and is in fluid communication with the send out pipe 252.

In one or more embodiments, the casing 20 is an annular member having a bore formed therethrough. The casing 20 can be adapted to depend vertically within the container 15. As described above, the pump 200 can be removed from the container 15 by pulling the pipe 210. The foot valve 40, attached to the bottom of the pump 200, can also be retrieved and serviced.

Figure 10:
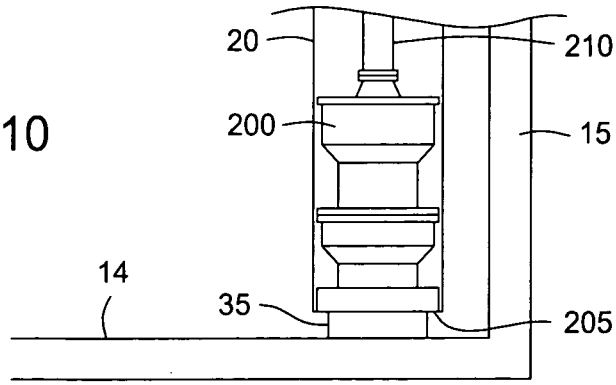
FIG. 10 depicts a partial schematic view of yet another liquefied gas storage container assembly according to one or more embodiments described.

FIG. 10 depicts a partial schematic view of yet another liquefied gas storage container assembly according to one or more embodiments described. In one or more embodiments, the pump 200 rests on a pedestal 35 disposed on the floor 14 of the container 15. The pedestal 35 can be attached to the inlet 205 of the pump 200. The pedestal 35 can be designed to hold the pump 200 off the floor 14 of the container 15, allowing the fluid (not shown) in the container 15 to enter the inlet 205 of the pump 200. In one or more embodiments, the pedestal 35 holds the pump 200 about one foot off the floor 14 of the container 15.

Specific embodiments can further include systems for pumping liquefied gas comprising: a container having an access port with a central axis disposed at an upper end thereof; a pump disposed within the container, the pump having a fluid inlet in fluid communication with a liquefied gas stored in the container and a fluid outlet; and at least one pipe segment having a first end and a second end, the first end in fluid communication with the fluid outlet of the pump, and the second end in fluid communication with an exterior of the container, wherein the pump is capable of lifting the liquefied gas through the at least one pipe segment and discharging the liquefied gas from the container at a pressure sufficient for distribution or further processing.

Specific embodiments can further include the methods of paragraph [0049] and one or more of the following embodiments: wherein the pump discharges the liquefied gas at a pressure of about 45 bar or more; wherein the pump discharge the liquefied gas at a pressure of about 100 bar or more; wherein the fluid transmitting pipe is made from a rigid pipe; wherein the pump is suspended within the container from the at least one pipe segment; wherein the pump rests on a bottom surface of the container such that liquefied gas is not obstructed from entering the inlet end of the pump; further including a pedestal attached to the fluid inlet of the pump to support the pump within the container; and/or further including a sealing gland disposed on the access port and adapted to seal off the container.

Specific embodiments can further include the methods of paragraph [0049] or paragraph [0050] further comprising an aperture formed through a portion of the sealing gland and a circumferential seal disposed about an inner surface of the aperture, wherein a portion of the at least one pipe segment protrudes through the aperture to the exterior of the storage container, and the seal within the aperture interacts with a portion of the pipe segment to create a seal against escaping gas therebetween.

Specific embodiments can further include the methods of paragraph [0051] and one or more of the following embodiments: further including a flange member disposed on the access port, the flange member having a central axis substantially aligned with the central axis of the access port and adapted to guide the pump into the access port; further including a single casing adapted to depend vertically within the container, wherein the pump and pipe are disposed therein, and the casing acts as a guide for vertical insertion and removal of the pump from the container; further including a sealing gland normally closing the top of the access port and an aperture through a portion of the sealing gland, wherein the pipe can move vertically through the sealing gland aperture without removing the gland from the top of the access port; further including a flange member appended to a bottom portion of the casing, wherein the flange member acts on the pump to substantially center the pump in the casing while the pump is being removed from the container; further including a single casing adapted to depend vertically within container, the casing having a central axis substantially aligned with a central axis of the access port, and wherein the pump and pipe fit freely in the casing; further including a foot valve normally closing off fluid communication within the casing; further including a sealing gland closing off the casing and an aperture formed through a portion of the sealing gland, wherein at least a portion of the pipe is disposed through the aperture; and/or wherein the pipe is made from stainless steel containing about 35% nickel.

Specific embodiments can further include systems for pumping liquefied gas comprising: a container having an access port with a central axis disposed at an upper end thereof; a pump having a fluid inlet and a fluid outlet; a fluid transmitting pipe with a first end and a second end, wherein the pipe is made from stainless steel containing about 35% nickel; a single casing adapted to depend vertically within the container, the casing having a central axis substantially aligned with a central axis of the access port; a sealing gland closing the top of the casing; an aperture formed through a portion of the sealing gland wherein a portion of the second end of the pipe protrudes through the sealing gland to an exterior of the storage container; and a foot valve at a bottom end of the casing, wherein the pump has a downwardly opening inlet adapted to engage the foot valve at the bottom of the casing for opening the foot valve to communicate a liquefied gas stored in the container with the interior of the pump, wherein the pump lifts the liquefied gas through the pipe, discharging the liquefied gas from the container while boosting the liquefied gas pressure from about 0.05 bar to about 100 bar.

Specific embodiments can further include methods for pumping a liquefied gas, comprising: pumping a liquefied gas from a container having an access port with a central axis disposed at an upper end thereof, using a pump disposed within the container, wherein the pump includes a fluid inlet in fluid communication with the liquefied gas stored in the container and a fluid outlet, and suspended within the container on at least one pipe segment having a first end and a second end, the first end in fluid communication with the fluid outlet of the pump, and the second end in fluid communication with an exterior of the container, wherein the pump is capable of lifting the liquefied gas through the at least one pipe segment and discharging the liquefied gas from the container at a pressure sufficient for distribution or further processing.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments, other and further embodiments may be devised without departing from the basic scope thereof, and the scope thereof is determined by the claims that follow.

What is claimed is:

1. A system for pumping liquefied gas, comprising:

a container having an access port disposed at an upper end thereof, the access port having a central axis;

a pump suspended within the container from at least one pipe segment, the pump having a fluid inlet in fluid communication with a liquefied gas stored in the container and a fluid outlet;

a sealing gland disposed on the access port and adapted to seal off the access port, wherein the at least one pipe segment has a first end and a second end, the first end in fluid communication with the fluid outlet of the pump, and the second end in fluid communication with an exterior of the container, wherein the pump is capable of lifting the liquefied gas through the at least one pipe segment while the pump is suspended within the container and discharging the liquefied gas from the container at a pressure sufficient for distribution or further processing;

an aperture formed through a portion of the sealing gland; and a circumferential seal disposed about an inner surface of the aperture, wherein a portion of the at least one pipe segment protrudes through the aperture to the exterior of the container, and the seal within the aperture interacts with the portion of the at least one pipe segment to create a seal against escaping gas therebetween, wherein the at least one pipe segment can move through the aperture without removing the sealing gland from the access port while maintaining the seal against escaping gas and wherein the circumferential seal is a stuffing box.

2. The system of claim 1, wherein the pump discharges the liquefied gas at a pressure of about 45 bar or more.

3. The system of claim 1, wherein the pump discharges the liquefied gas at a pressure of about 100 bar or more.

4. The system of claim 1, wherein the at least one pipe segment is rigid.

5. The system of claim 1, wherein the pump rests near a bottom surface of the container such that the liquefied gas is not obstructed from entering the fluid inlet of the pump.

6. The system of claim 1, wherein the at least one pipe segment is made from stainless steel containing about 35% nickel.

7. The system of claim 1, wherein the pump is rated for 6,600 volts.

8. A system for pumping liquefied gas, comprising:

a container having an access port disposed at an upper end thereof, the access port having a central axis;

a pump suspended within the container from at least one pipe segment, the pump having a fluid inlet and a fluid outlet, wherein the at least one pipe segment has a first end in fluid communication with the fluid outlet of the pump and a second end in fluid communication with an exterior of the container, wherein the pump is capable of lifting the liquefied gas through the at least one pipe segment and discharging liquefied gas from the container at a pressure sufficient for distribution or further processing;

a sealing gland disposed on the access port and adapted to seal off the access port;

a casing vertically disposed within the container, extending from the access port to the bottom of the pump, wherein the casing has a central axis substantially aligned with the central axis of the access port, and wherein the pump and the at least one pipe segment are disposed within the casing;

an aperture formed through a portion of the sealing gland; and a circumferential seal disposed about an inner surface of the aperture, wherein a portion of the at least one pipe segment protrudes through the aperture to the exterior of the container, and the seal within the aperture interacts with the portion of the at least one pipe segment to create a seal against escaping gas therebetween, wherein the at least one pipe segment can move through the aperture without removing the sealing gland from the access port while maintaining the seal against escaping gas and wherein the circumferential seal is a stuffing box.

* * * * *